US009016827B2

(12) United States Patent
Owaki

(10) Patent No.: US 9,016,827 B2
(45) Date of Patent: Apr. 28, 2015

(54) LIQUID EJECTING APPARATUS

(71) Applicant: Seiko Epson Corporation, Tokyo (JP)

(72) Inventor: Hiroshige Owaki, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/225,624

(22) Filed: Mar. 26, 2014

(65) Prior Publication Data

US 2014/0292853 A1 Oct. 2, 2014

(30) Foreign Application Priority Data

Mar. 27, 2013 (JP) ..... 2013-067697

(51) Int. Cl.
*B41J 29/38* (2006.01)
*B41J 11/00* (2006.01)
*B41J 2/045* (2006.01)

(52) U.S. Cl.
CPC ..... *B41J 11/0085* (2013.01); *B41J 2/04581* (2013.01)

(58) Field of Classification Search
CPC ..... B41J 11/0085; B41J 2/04581
See application file for complete search history.

(56) References Cited

U.S. PATENT DOCUMENTS 6,543,948 B2 * 4/2003 Beehler et al. ..... 400/635
6,637,960 B2 * 10/2003 Garcia et al. ..... 400/648

FOREIGN PATENT DOCUMENTS

JP 2002-127515 A 5/2002

* cited by examiner

*Primary Examiner* — Julian Huffman
(74) *Attorney, Agent, or Firm* — Maschoff Brennan

(57) ABSTRACT

There is provided a liquid ejecting apparatus including: a liquid ejecting head that relatively moves in a first direction with regard to a discharged medium, and discharges liquid with regard to the discharged medium; a transport section that relatively transports the discharged medium in a second direction with regard to the liquid ejecting head; an adsorption section that adsorbs a surface of the discharged medium, which is opposite to the liquid ejecting head; and a control section that performs control such that the adsorption section performs absorption when the liquid ejecting head discharges the liquid with regard to the discharged medium and such that adsorption force is caused to be weak compared to a case in which the liquid is discharged when the discharged medium is relatively transported in the second direction by the transport section.

12 Claims, 6 Drawing Sheets

LIQUID EJECTING APPARATUS

CROSS REFERENCES TO RELATED APPLICATIONS

This application claims priority to Japanese Patent Application No. 2013-067697 filed on Mar. 27, 2013. The entire disclosure of Japanese Patent Application No. 2013-067697 is hereby incorporated herein by reference.

BACKGROUND

1. Technical Field

The present invention relates to a liquid ejecting apparatus.

2. Related Art

As a liquid ejecting head which ejects liquid, an ink jet type recording head is known in which piezoelectric elements (actuator devices) are provided on one surface side of a flow channel formation substrate provided with pressure chambers that communicate with nozzles, and which discharges ink droplets from the nozzles by fluctuating pressures in the pressure chambers based on the displacement of the piezoelectric elements. In an ink jet type recording apparatus on which such an ink jet type recording head is mounted, an image is formed by discharging ink to a recording medium and permeating the recording medium with the ink. In this case, when the recording medium absorbs ink, a portion which absorbs the ink expands and is floated, and thus unevenness occurs around the portion. If such unevenness occurs, the distance between the liquid ejecting surface of the recording head and the recording medium changes, and thus it is difficult for the ink jet type recording apparatus to acquire desired printing properties.

In order to reduce the unevenness, it is known that a suction fan is provided in a platen on which the recording medium is placed and the recording medium is adsorbed onto the platen by driving the suction fan.

According to an invention which is disclosed in JP-A-2002-127515 (claim 1 and the like), when a recording medium is adsorbed onto a platen, it is possible to cause the recording medium to be flat, and thus it is possible to suppress the deterioration of printing properties due to the occurrence of unevenness on the recording medium. However, in such an ink jet type recording apparatus, friction force increases due to suction, and thus there is a case in which it is difficult to transport the recording medium. In this case, there is a case in which it is difficult to acquire desired printing properties.

SUMMARY

An advantage of some aspects of the invention is to provide a liquid ejecting apparatus capable of improving printing properties.

According to an aspect of the invention, there is provided a liquid ejecting apparatus including: a liquid ejecting head that relatively moves in a first direction with regard to a discharged medium, and discharges liquid with regard to the discharged medium; a transport section that relatively transports the discharged medium in a second direction with regard to the liquid ejecting head; an adsorption section that adsorbs a surface of the discharged medium, which is opposite to the liquid ejecting head; and a control section that performs control such that the adsorption section performs absorption when the liquid ejecting head discharges the liquid with regard to the discharged medium and such that adsorption force is caused to be weak compared to a case in which the liquid is discharged when the discharged medium is relatively transported in the second direction by the transport section. When the control section is included which performs control such that adsorption is performed when the liquid ejecting head discharges the liquid with regard to the discharged medium, and such that the adsorption force is caused to be weak compared to a case in which the liquid is discharged when the discharged medium is relatively transported in the second direction by the transport section, the adsorption force is weakened (reduced) when the discharged medium is relatively transported in the second direction, with the result that it is possible to smoothly transport the discharged medium, and thus it is possible to acquire desired printing properties. Meanwhile, here, weakening the adsorption force includes a state in which adsorption is not performed at all (a case in which the adsorption force is zero).

In the liquid ejecting apparatus, when the liquid ejecting head discharges the liquid with regard to the discharged medium, the control section may control the adsorption section such that the adsorption section performs adsorption in a region of the discharged medium, which faces the liquid ejecting head and such that the adsorption force is caused to be weak in a region which does not face the liquid ejecting head compared to a case in which the region faces the liquid ejecting head. With the configuration, it is possible to acquire further desired printing properties by reducing stress with regard to the discharged medium.

In the liquid ejecting apparatus, the adsorption section may be provided throughout the first direction, and is configured to be able to change the adsorption force for each of a plurality of regions which are acquired through division throughout the first direction, and the control section may control the adsorption section such that the adsorption section in the region which faces the liquid ejecting head performs adsorption and such that the adsorption section in the region which does not face the liquid ejecting head causes the adsorption force to be weak compared to the case in which the region faces the liquid ejecting head.

In the liquid ejecting apparatus, the adsorption section may be configured to be able to relatively move in the first direction with regard to the discharged medium, and the adsorption section may move with regard to the liquid ejecting head, and may be controlled such that the adsorption section performs adsorption in the region which faces the liquid ejecting head and such that the adsorption force is caused to be weak in the region which does not face the liquid ejecting head compared to the case in which the region faces the liquid ejecting head.

In the liquid ejecting apparatus, the adsorption section may be a suction section which adsorbs the discharged medium in such a way as to form negative pressure by sucking the surface of the discharged medium, which is opposite to the liquid ejecting head.

In the liquid ejecting apparatus, the liquid ejecting apparatus may further include a platen that supports a surface of the discharged medium, which is opposite to the liquid ejecting head while relatively moving with regard to the discharged medium, and the adsorption section may adsorb the discharged medium onto the platen.

In the liquid ejecting apparatus, when the discharged medium is relatively transported in the second direction by the transport section, the control section may weaken the adsorption force to zero. When the adsorption force is weakened to zero, it is easy to perform transport.

In addition, the control section may control a print operation of the liquid ejecting head and an absorption operation of the adsorption section based on a print signal.

In addition, the control section may set the adsorption force which is applied to the discharged medium to zero on an outer side than the discharged medium.

In addition, the transport section relatively may transport the discharged medium in the second direction whenever the liquid ejecting head finishes relative movement in the first direction, and the control section may control the adsorption section such that the adsorption force is caused to be weak whenever the transport section transports the discharged medium.

In addition, when the adsorption force is caused to be weak by the adsorption section, the control section may set the adsorption force to 50% of a case in which the adsorption force is not caused to be weak.

In addition, the adsorption section may include a suction fan, and the suction fan may be provided inside of the platen.

Alternatively, according to another aspect of the invention, there is provided a method of discharging liquid to a discharged medium by a liquid ejecting head, including: causing a transport section to repeatedly perform an operation of relatively transporting the discharged medium with regard to the liquid ejecting head and an operation of not transporting the discharged medium; and controlling an adsorption section that adsorbs the discharged medium such that adsorption force with regard to the discharged medium becomes weak in a case in which the discharged medium is transported by the transport section, compared to a case in which the discharged medium is not transported by the transport section.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail based on embodiments.

First Embodiment

Figure 1:
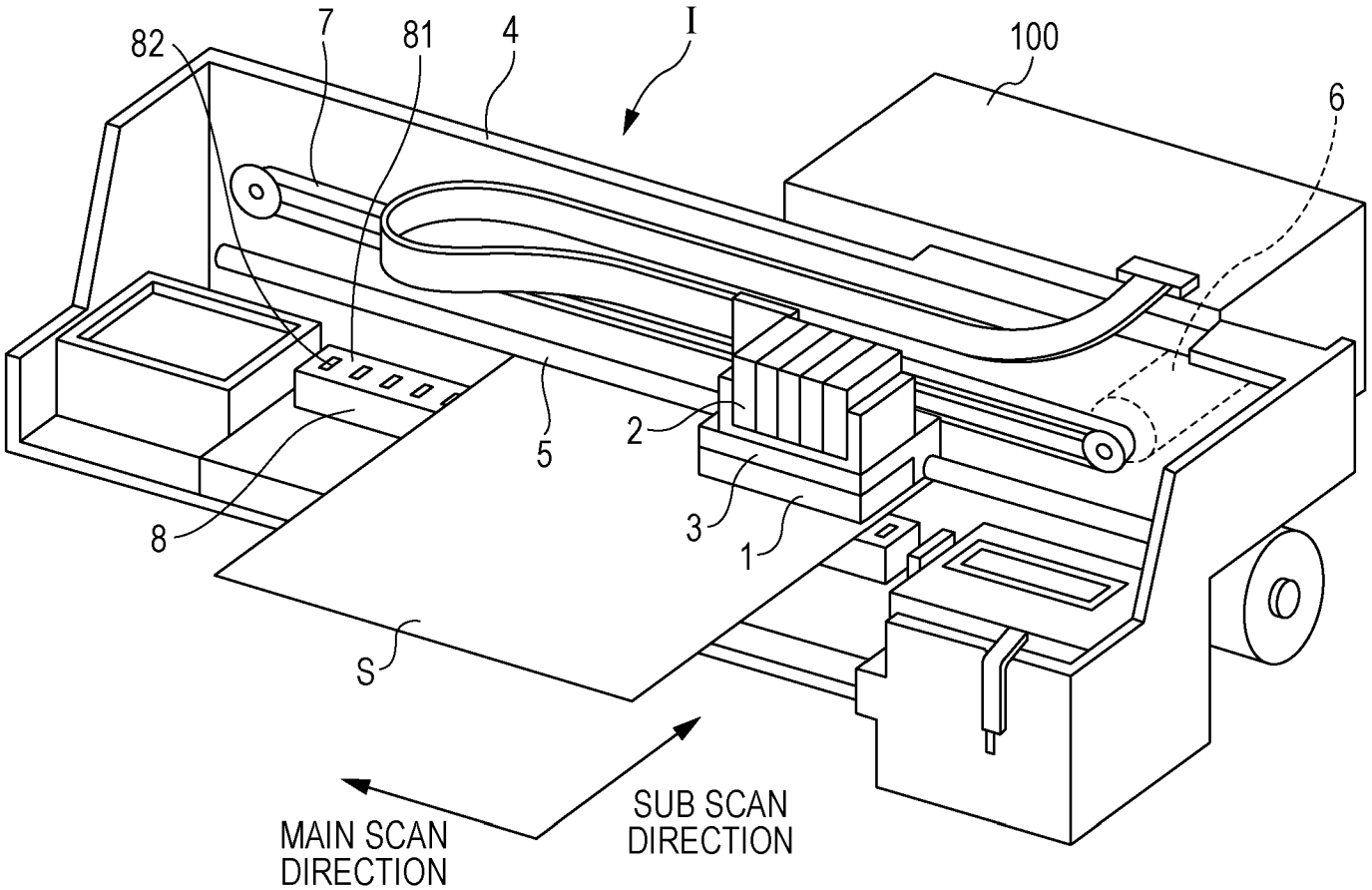
FIG. 1 is an outline perspective view illustrating a recording apparatus according to a first embodiment.

FIG. 1 is an outline perspective view illustrating a recording apparatus according to a first embodiment.

In a recording apparatus I, an ink cartridge 2 which configures an ink supply section is detachably provided in an ink jet type recording head 1 (hereinafter, referred to as a recording head 1), and a carriage 3, on which the recording head 1 is mounted, is provided on a carriage shaft 5 attached to a device main body 4 such that the carriage 3 can move in a shaft direction. The recording head 1 discharges, for example, a black ink composition and a color ink composition.

In addition, although being described in detail later, the ink jet type recording apparatus I is provided with a control device 100 that is a control section which controls the operation of the ink jet type recording apparatus I.

Further, when the driving power of a driving motor 6 is transmitted to the carriage 3 through a plurality of gear wheels which are not shown in the drawing and a timing belt 7, the carriage 3 on which the recording head 1 is mounted is moved along the carriage shaft 5. On the other hand, a platen 8 is provided along the carriage shaft 5 in the device main body 4, and a recording sheet S, which is a recording medium, such as paper, fed by a feeding roller which is not shown in the drawing, is placed on the platen 8 and then is transported.

In the embodiment, the platen 8 includes slit-shaped openings 82 which are provided in a placement surface 81 on which the recording sheet S is placed. The openings 82 are formed in plural and are arranged in a longitudinal direction of the platen 8 along a main scan direction (which will be described in detail later).

Figure 2:
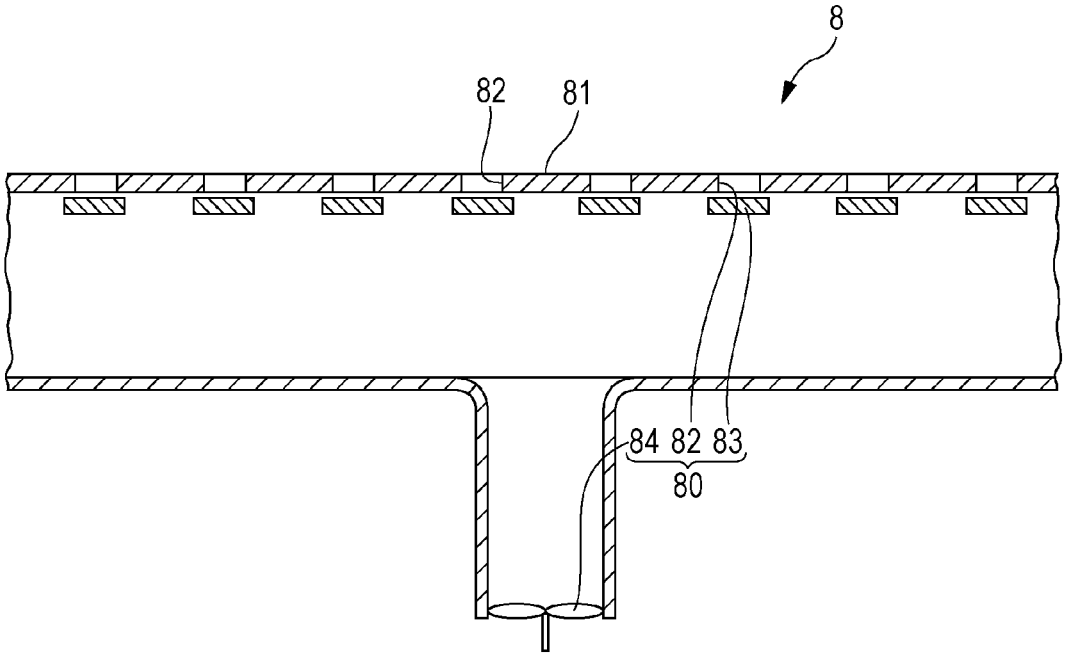
FIG. 2 is a schematic cross-sectional view illustrating a platen according to the first embodiment.

As shown in FIG. 2, shutters 83 which face the respective openings 82 are provided inside of the platen 8. The shutters 83 are configured to be openable, and the control device 100 which will be described in detail later controls the opening and shutting of the respective shutters 83. In addition, a suction fan 84 is provided inside of the platen 8, and thus it is possible to cause the inside of the platen 8 to be a negative pressure state. Therefore, when the suction fan 84 is driven and the shutters 83 are in an open state, it is possible to suck and adsorb the recording sheet S, which is placed over the openings 82 corresponding to the shutters 83 in the open states, from a back side of a print surface (that is, from a surface opposite to the recording head). In addition, when the shutters 83 are in a closed state, the recording sheet S which is placed over the openings 82 corresponding to the shutters 83 in the closed state is not adsorbed.

The drive of the suction fan 84 is controlled by the control device 100. In the embodiment, a suction section 80 is configured from the suction fan 84, the openings 82 and the shutters 83.

Figure 3A:
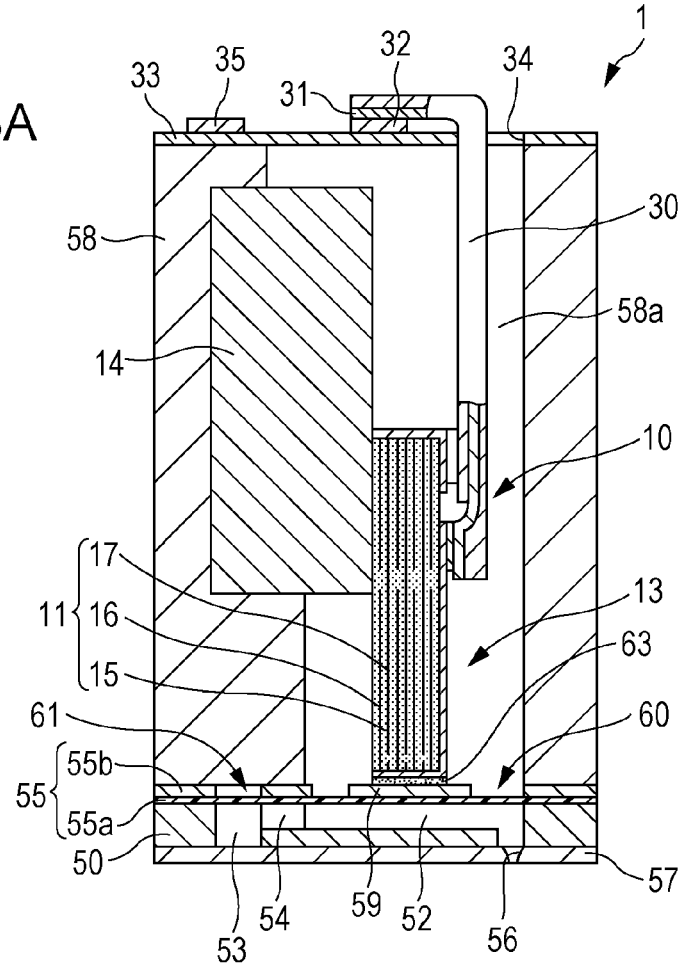
FIGS. 3A and 3B are cross-sectional views illustrating a recording head according to the first embodiment.
Figure 3B:
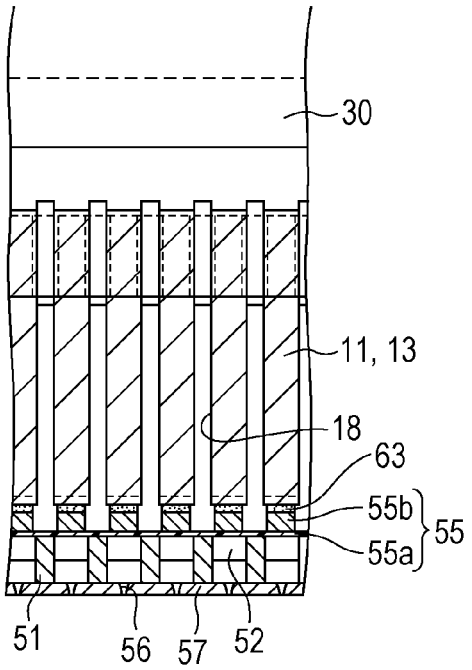

Here, the ink jet type recording head 1 which is mounted on the ink jet type recording apparatus I will be described. FIGS. 3A and 3B are cross-sectional views illustrating the ink jet type recording head which is an example of a liquid ejecting head according to the first embodiment of the invention.

As shown in FIGS. 3A and 3B, a flow channel formation substrate 50 is formed of a silicon single crystal substrate, and pressure generating chambers 52 which are formed by a plurality of walls 51 are arranged in the width direction (short dimension direction) on one side surface portion of the formation substrate 50. In addition, one end side of the longitudinal direction of each of the pressure generating chambers 52 is communicated with a manifold 53 which is used to supply ink that is an example of liquid to each of the pressure generating chambers 52 through an ink supply path 54 which is an example of a liquid supply path. In addition, the opening surface side of the pressure generating chambers 52 in the flow channel formation substrate 50 is sealed by a vibration plate 55, and the other side thereof is adhered to a nozzle plate 57, which is an example of a nozzle formation member in which nozzle openings 56 are punched, through an adhesive agent or a thermal welding film.

The vibration plate 55 which is formed on the flow channel formation substrate 50 is formed using a composite plate of an elastic film 55*a* which is formed of, for example, an elastic member such as a resin film, and a support plate 55*b* which supports the elastic film 55*a* and is formed of, for example, a metal material. The side of the elastic film 55*a* is bonded to the flow channel formation substrate 50. For example, in the embodiment, the elastic film 55*a* is formed of polyphenylene sulfide (PPS) which has a thickness of approximately several μm, and the support plate 55*b* is formed of a stainless steel plate (SUS) which has a thickness of approximately several tens of μm. In addition, insular portions 59 which come in contact with tip portions of piezoelectric actuators 11 are provided in regions of the vibration plate 55, which faces the respective pressure generating chambers 52. That is, a thin wall section 60 is formed which has a thinner thickness than other regions of the vibration plate 55, which face the peripheries of the respective pressure generating chambers 52. Each of the insular portions 59 is provided on the inner side of the thin wall section 60. In the embodiment, when the insular portions 59 are provided in the vibration plate 55, a thick section which has a thicker thickness than other regions (thin wall section 60) is provided in the vibration plate 55.

In addition, similar to the thin wall section 60, a compliance section 61, which is substantially configured from only the elastic film 55*a* in such a way that the support plate 55*b* is removed through etching, is provided in a region which faces the manifold 53 of the vibration plate 55. Meanwhile, when a change in pressure is generated in the manifold 53, the compliance section 61 performs a function to absorb the change in pressure in such a way that the elastic film 55*a* of the compliance section 61 is changed and a function to always hold a fixed pressure in the manifold 53.

A head case 58, which includes the ink supply paths that are an example of the liquid supply path connected to the ink cartridge that is an example of a plurality of liquid storages which are not shown in the drawing, is fixed on the vibration plate 55, and an piezoelectric actuator unit 10 is precisely positioned in and fixed to the head case 58. That is, the head case 58 is provided with an accommodation portion 58*a* which passes therethough, and the piezoelectric actuator unit 10 is provided on one inner side of the accommodation portion 58*a* in such a way that the tip of each of the piezoelectric actuators 11 is bonded and fixed to each of the insular portions 59 (thick portions) which are provided in regions corresponding to the respective pressure generating chambers 52 on the vibration plate 55 through adhesives 63.

Here, the piezoelectric actuator unit 10 includes a piezoelectric actuator forming member 13 that includes a column in which the plurality of piezoelectric actuators 11 are arranged in the width direction thereof, and a fixing plate 14 to which the base end portion (the other end portion) side of the piezoelectric actuator forming member 13 is fixed and bonded such that the tip portion (one end portion) side of the piezoelectric actuator forming member 13 becomes a free end.

The piezoelectric actuator forming member 13 is formed by alternately laminating a piezoelectric material layer 15 and inner electrodes which configure two poles of each of the piezoelectric actuators 11, that is, an individual electrode 16 which is electrically independent from adjacent piezoelectric actuators 11, and a common electrode 17 which is electrically common to the adjacent piezoelectric actuators 11.

In the piezoelectric actuator forming member 13, a plurality of slits 18 are formed through, for example, wire-saw or the like, division is performed on the tip portion sides thereof like a comb shape, and thus the columns of the piezoelectric actuators 11 are formed.

In addition, the regions of the piezoelectric actuators 11 which are bonded to the fixing plate 14 are inactive regions which do not contribute to vibration. When a voltage is applied between the individual electrodes 16 and the common electrodes 17 which configure the piezoelectric actuators 11, only regions on the tip portion sides which are not bonded to the fixing plate 14 vibrate.

With regard to the piezoelectric actuator unit 10, a surface of the fixing plate 14, which is opposite to the surface to which the piezoelectric actuator forming member 13 is fixed, is fixed to the accommodation portion 58*a* of the head case 58. In addition, the tip surfaces of the respective piezoelectric actuators 11 are bonded to the insular portions (thick portions) 59 of the vibration plate 55 through the adhesives 63.

Further, a wiring substrate 33 is fixed on the head case 58, the wiring substrate 33 being provided with a plurality of conductive pads 32 to which wirings 31 of the circuit substrate 30 are respectively connected. The accommodation portion 58*a* of the head case 58 is substantially covered by the wiring substrate 33. In the wiring substrate 33, a slit-shaped opening portion 34 is formed in a region which faces the accommodation portion 58*a* of the head case 58, and the circuit substrate 30 is bent and drawn from the opening portion 34 of the wiring substrate 33 toward the outside of the accommodation portion 58*a*.

Here, in the embodiment, the circuit substrate 30 which configures the piezoelectric actuator unit 10 is configured from, for example, a Chip On Film (COF) equipped with a driving IC (not shown in the drawing) in order to drive the piezoelectric actuators 11. Further, the wirings 31 of the circuit substrate 30 are respectively connected to the individual electrodes 16 and the common electrodes 17 which configure the piezoelectric actuators 11 using, for example, solder, an anisotropic conductive material, or the like on the base end portion thereof. On the other hand, the wirings 31 are bonded to the respective conductive pads 32 of the wiring substrate 33 on the tip portion side thereof. More specifically, in a state in which the tip portion of the circuit substrate 30 which is drawn from the opening portion 34 of the wiring substrate 33 toward the outside of the accommodation portion 58*a* is bent along the surface of the wiring substrate 33, the respective wirings 31 are bonded to the conductive pads 32 of the wiring substrate 33.

Meanwhile, when ink droplets are discharged, such an ink jet type recording head 1 is configured to discharge ink droplets from the predetermined nozzle openings 56 by changing the capacity of each of the pressure generating chambers 52 based on the deformation of the piezoelectric actuators 11 and the vibration plate 55. More specifically, when ink is supplied to the manifold 53 from the ink cartridge 2 shown in FIG. 1, the ink is distributed to each of the pressure generating chambers 52 through the ink supply path 54. Actually, the piezoelectric actuators 11 are shrunk by applying a voltage to the piezoelectric actuators 11. Therefore, the vibration plate 55 is deformed together with the piezoelectric actuators 11, with the result that the capacities of the pressure generating chambers 52 expand, and thus the ink is drawn into the pressure generating chambers 52. Further, after the inside is filled with the ink until the ink reaches the nozzle openings 56, the voltage which is applied to the individual electrodes 16 and the common electrodes 17 of the piezoelectric actuators 11 is released based on a recording signal which is supplied from the control device 100 through the wiring substrate 33. Therefore, the piezoelectric actuators 11 expand and return to the original states, and the vibration plate 55 is also displaced and returns to the original state thereof. As a result, the capacities of the pressure generating chambers 52 are shrunk and pressure in the pressure generating chambers 52 becomes high, and thus ink droplets are discharged from the nozzle openings 56.

The control device 100 that controls the ink jet type recording apparatus I which includes such an ink jet type recording head 1 will be described. Meanwhile, FIG. 4 is a block diagram illustrating a control system of a recording apparatus according to the first embodiment of the invention.

Figure 4:
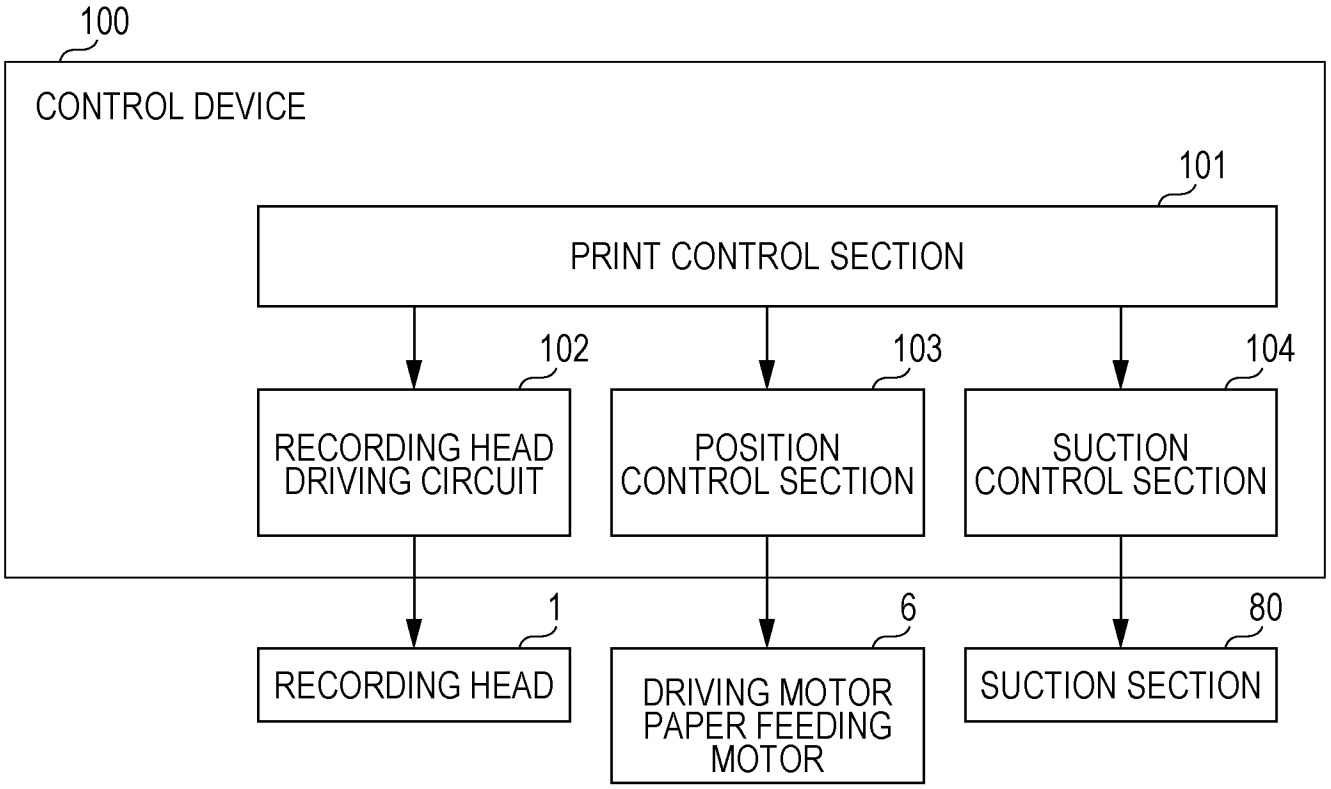
FIG. 4 is a block diagram illustrating a control system according to the first embodiment.

As shown in FIG. 4, the ink jet type recording apparatus I includes the recording head 1 that is a mechanical section which actually performs printing, a driving motor 6 and paper feeding motor, and the control device 100 that controls the operations of the recording head 1 and the driving motor 6 and paper feeding motor.

The control device 100 includes a print control section 101, a recording head driving circuit 102, a position control section 103, and a suction control section 104.

When a print signal is input from the ink jet type recording apparatus I to the control device 100, the print control section 101 starts controlling a print operation of the recording head 1. For example, the print control section 101 applies a driving pulse (recording signal) to the piezoelectric actuators 11 in accordance with the input of the print signal through the recording head driving circuit 102, and causes the recording head 1 to discharge ink. In addition, when the print signal is input to the ink jet type recording apparatus I, the print control section 101 inputs a print operation signal to the position control section 103 and the suction control section 104.

The position control section 103 determines the positions of a main scan direction and a sub scan direction in accordance with the print operation signal when the recording head 1 performs printing or performs a cleaning operation.

When the print operation signal is input to the position control section 103, the position control section 103 determines the position of the main scan direction of the recording head 1 by driving the driving motor 6 and moving the carriage 3 in the main scan direction, and determines the position of the sub scan direction of the recording head 1 on the recording sheet S by driving the paper feeding motor which is not shown in the drawing and moving the recording sheet S in the sub scan direction. That is, the main scan direction (first direction) is the movement direction of the carriage 3, and the sub scan direction (second direction) is a direction which crosses the main scan direction, that is, the transport direction of the recording sheet S in the embodiment. Further, when printing is performed, the position control section 103 causes the recording sheet S to move in the sub scan direction while moving the carriage 3 on which the recording head 1 is mounted in the main scan direction. In the embodiment, when the recording head 1 is caused to reciprocate in the main scan direction once, the recording sheet S is caused to move in the sub scan direction.

The suction control section 104 controls an operation of the suction section 80 in accordance with the print operation signal. Hereinafter, details will be described.

The suction control section 104 starts controlling when the print signal is input from the print control section 101. In the embodiment, after the suction control section 104 starts controlling, the suction control section 104 operates the suction fan 84 and causes the shutters 83 to open and close in conjunction with the operation of the carriage 3.

More specifically, when the print operation signal is input, the suction control section 104 performs suction when the recording head 1 performs printing on the recording sheet S and does not perform suction when the recording sheet S is transported in the sub scan direction. Further, a case in which the printing is performed will be described. The suction control section 104 adsorbs a region of the recording sheet S, which faces the recording head 1, and does not adsorb a region in which the recording head 1 is moved and which faces the recording head 1.

The content of control performed by the suction control section 104 will be described in detail. When the print operation signal is input, the suction control section 104 operates the suction fan 84. When the suction fan 84 is operated and the recording sheet S is transported in the sub scan direction, the suction control section 104 performs control such that all of the shutters 83 are in the closed state.

Since a configuration is made as described above, when the recording sheet S is transported in the sub scan direction, the recording sheet S is not sucked, with the result that the recording sheet S is easily transported, and thus it is possible to suppress the deterioration of printing properties by suppressing the deviation of printing positions. That is, since suction force is large when all of the shutters 83 of the openings 82 of the platen 8 are in the open state, it is difficult to transport the recording sheet S in the sub scan direction even when the recording sheet S is caused to be transported in the sub scan direction, with the result that the printing positions are easily deviated, and thus it is considered that the deviation of the printing positions result in the deterioration of printing properties. Here, in the embodiment, the suction control section 104 performs control such that the suction section 80 stops when transporting is performed, and thus the deterioration of printing properties is suppressed by suppressing the deviation of printing positions.

Further, in the embodiment, when the carriage 3 operates and moves in the main scan direction and the recording head 1 discharges ink (performs printing), the suction control section 104 performs control such that only the shutters 83 which are present in positions that face the recording head 1 are in the open state and the shutters 83 which are present in positions that do not face the recording head 1 are in the closed state.

Therefore, the suction control section 104 acquires positional information of the carriage 3, that is, the recording head 1 from the position control section 103, and acquires information about the driving of the recording head 1 from the recording head driving circuit 102. Further, the suction control section 104 determines which shutters 83 provided in the openings 82 are caused to be in the open state based on the information, and causes the shutters 83 which are present in the positions that face the recording head 1 to be in the open state.

Meanwhile, when the recording head 1 moves in the main scan direction and is positioned further on an outer side than the recording sheet S, the suction control section 104 performs control such that all of the shutters 83 are in the closed state.

Figure 5:
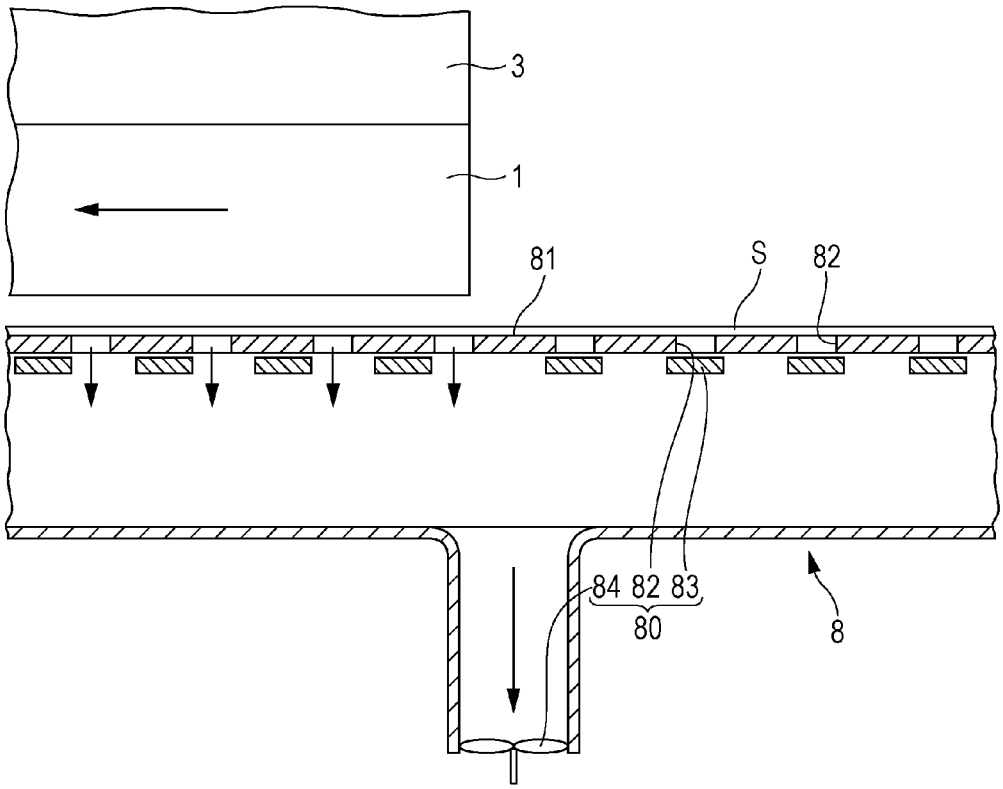
FIG. 5 is a schematic cross-sectional view illustrating an operation of a suction section according to the first embodiment.

When the carriage 3 is driven and is moved in the main scan direction as shown in FIG. 5 due to the control performed by the suction control section 104, only the shutters 83 which are present in the positions that face the recording head 1 are in the open state, and the shutters 83 which are in the positions that do not face the recording head 1 are in the closed state. In the subsequent moment, since the recording head 1 moves, the shutters 83 which are present in positions that currently face the recording head 1 are in the closed state. That is, the suction section 80 which is present in a region that does not face the liquid ejecting head has weak adsorption force, compared to a case in which the suction section 80 faces the liquid ejecting head. Further, since the shutters 83 which are present in positions that face the recording head 1 which discharges ink are in the open state, the recording sheet S is adsorbed onto the placement surface 81 of the platen 8. Therefore, since the region of the recording sheet S which is printed by the recording head 1 is flat and does not include unevenness, the deterioration of printing properties is suppressed.

Further, in the position of the recording sheet S which does not face the recording head 1, the shutters 83 are in the closed state, the recording sheet S is not adsorbed onto the placement surface 81 of the platen 8, and the recording sheet S is adsorbed onto only regions of the platen 8 which face the recording head 1 that ejects liquid, Therefore, it is possible to further suppress the deterioration of printing properties.

That is, even though all of the shutters 83 of the openings 82 of the platen 8 are in the open state and the recording sheet S is entirely sucked in the main scan direction while ink is being discharged from the recording head 1, the recording sheet is transported in the sub scan direction without problem. However, if the recording sheet S is entirely sucked in the main scan direction, stress is added to the recording sheet S, and thus it may be considered that the recording sheet S is easily wrinkled depending on the kind of the recording sheet S. In contrast, since suction is performed in only regions of the platen 8, which face the recording head 1 that ejects liquid in the embodiment, stress which is added to the recording sheet S is small, and thus it is difficult to wrinkle. Therefore, as in the embodiment, it is preferable to make a configuration such that the shutters 83 are in the closed state and the recording sheet S is not adsorbed onto the placement surface 81 of the platen 8 in the positions of the recording sheet S, which do not face the recording head 1.

As described above, in the embodiment, when printing is being performed (when liquid is being discharged), the liquid discharge regions which face the recording head 1 are sucked and become a flat surface. When the recording sheet S is transported in the sub scan direction, the recording sheet S is not sucked. Therefore, it is easy to transport the recording sheet S, and it is possible to suppress the deterioration of printing properties by suppressing the deviation of printing positions.

Figure 6:
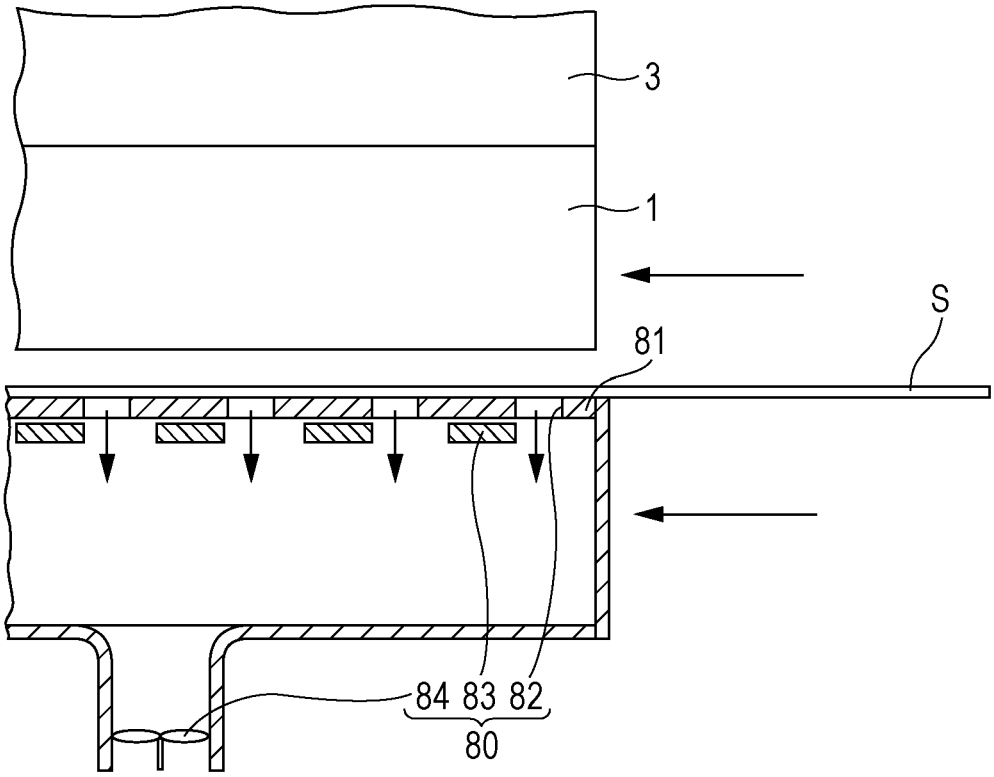
FIG. 6 is a schematic cross-sectional view illustrating an operation of another suction section.

In the embodiment, the recording sheet S is sucked in correspondence to the recording head 1 which moves in the main scan direction by controlling the open and closed states of the respective shutters 83 which are provided in the openings 82 that are formed in the platen 8. However, the invention is not limited thereto. For example, as shown in FIG. 6, the suction section 80 itself may be configured to move in correspondence to the recording head 1 that moves in the main scan direction. In addition, the suction fan 84 itself may move in the platen 8. That is, the suction region may be configured to move in correspondence to the movement of the recording head 1. At this time, it is preferable to make a structure in which the suction section 80 and the recording head 1 are in conjunction with each other using a gear, a belt, or the like such that the suction section 80 is present in a position which faces the recording head 1.

The recording sheet S is adsorbed onto the suction section 80 in the embodiment. However, the invention is not limited thereto. If the recording sheet S can be adsorbed onto the placement surface of the platen 8 in a prescribed case, any section may be used. For example, a configuration may be made such that adsorption can be performed using static electricity only in the prescribed case as described above. In addition, a configuration may be made such that the recording sheet S is adsorbed from the side of the recording head 1 by pressing the recording sheet S from the side of the recording head 1.

In the embodiment, the shutters 83 are in the closed states (the states in which suction force is zero) in the prescribed case. However, the present invention is not limited thereto and the opening degrees of the shutters 83 may be changed. For example, a configuration may be made such that suction force is lowered by setting the opening degrees of the shutters 83 to 50% of the openings 82, that is, the adsorption force of the recording sheet S becomes weak. Even when such a configuration is made, it is possible to smoothly transport the recording sheet S in the sub scan direction because the suction force is lowered.

The shapes of the openings 82 are the slit shapes in the embodiment. However, the invention is not limited thereto. For example, a plurality of rectangular openings may be provided in a matrix shape and the shapes thereof may be circles. Openings which are smaller than the recording head 1 may be provided.

A single suction fan 84 is provided for the plurality of openings 82 and suction is performed by driving the suction fan 84 and causing the inside of the platen 8 to be a negative pressure in the embodiment. However, the invention is not limited thereto. A plurality of suction fans 84 may be provided in the platen 8. When the plurality of suction fans 84 are provided, suction control may be performed using the suction fans 84 for the respective regions by dividing the inside of the platen 8 into a plurality of regions corresponding to the respective suction fans 84. In addition, adsorption force for the suction control which is performed by the suction fans 84 may be individually changed for the respective regions.

The open and closed states of the respective shutters 83 corresponding to the openings 82 are respectively controlled in the embodiment. However, the invention is not limited thereto. For example, each of the openings 82 and each of the shutters 83 which correspond thereto are divided into a plurality of regions in the longitudinal direction of the platen 8, and then the open and closed states of each of the shutters 83 may be controlled for each of the regions. In addition, when the respective openings 82 and the respective shutters 83 which correspond thereto are divided between the plurality of regions in the longitudinal direction of the platen 8 as described above, the shutters 83 may be provided throughout the plurality of openings 82 in the respective regions while the respective shutters 83 are not provided for the respective openings 82.

Only the shutters 83 of the openings 82 which are present in regions that face the recording head which moves in the main scan direction are in the open states in the embodiment. However, the invention is not limited thereto. A configuration may be made such that the shutters 83 of the openings 82 in the movement direction of the recording head 1 are set to the open state in advance. With such a configuration, it is possible to securely adsorb the recording sheet S, and thus it is possible to more stably perform printing. In particular, when the recording head 1 is moved at high speed, it is possible to suppress the deterioration of printing properties.

In the embodiment, when the recording head 1 moves to the outer side than the recording sheet S, all of the shutters 83 of the openings 82 are in the closed state even when the recording sheet S does not move in the sub scan direction. However, the invention is not limited thereto. If the recording sheet S does not move in the sub scan direction, the shutters 83 may be in the open state. In addition, when the recording head 1 moves to the outer side than the recording sheet S, the shutters 83 corresponding to the openings 82 that are present in a position to which the recording head 1 subsequently moves may be in the open state and the remaining openings 82 may be in the closed state.

Further, in the above-described embodiment, an example is shown in which the recording sheet S is moved in the sub scan direction if the recording head 1 reciprocates in the main scan direction once. However, the invention is not limited thereto. If the recording head 1 is moved in the main scan direction in a plurality of times, the recording sheet S may move in the sub scan direction. In this case, when the recording head 1 is moved to an outer side than the recording sheet S, the shutters 83 may be in the open state or in the closed state.

In addition, in the above-described embodiment, the recording head 1 is moved in the main scan direction, that is, in the first direction and the recording sheet S is moved in the sub scan direction, that is, in the second direction. However, the invention is not limited thereto. The recording head 1 may be relatively moved in the first direction with regard to the recording sheet S, and the recording sheet S may be relatively moved in the second direction with regard to the recording head 1. For example, the recording head 1 may be configured to be moved in the first direction and the second direction.

Other Embodiments

Hereinabove, although the embodiment of the invention is described, the basic configuration of the invention is not limited to the above embodiment. For example, two or more combinations of the above-described embodiment and a modification example may be provided, and one or more combinations of the embodiment, a modification example, and an embodiment below may be provided.

In addition, in the above-described embodiment, the piezoelectric actuators 11 using the piezoelectric material layer 15 are exemplified as a pressure generation section that generates pressure change in the flow channel (pressure generating chamber). However, the pressure generation section is not particularly limited thereto and so-called electrostatic actuators, thermal actuators, or the like may be used. Further, the structure of the recording head 1 is not limited and various structures may be used.

In addition, in the above-described example, the ink jet type recording apparatus I has a configuration in which the ink cartridge 2 that is a liquid storage section is mounted on the carriage 3. However, the invention is not particularly limited thereto. For example, the liquid storage section, such as an ink tank, may be fixed to the device main body 4, and the storage section may be connected to the ink jet type recording head 1 through a supply pipe such as a tube. In addition, the liquid storage section may not be mounted on the ink jet type recording apparatus.

Meanwhile, in the above-described example, a configuration in which the recording head 1 is mounted on the carriage 3 and is moved in the main scan direction is exemplified as the ink jet type recording apparatus I. However, such a configuration is not particularly limited. The ink jet type recording apparatus I may be, for example, a so-called line-type recording apparatus which fixes the recording head 1 and performs printing by moving the recording sheet S, such as paper, in the sub scan direction. Even in this case, a configuration is made such that the suction section 80 is not driven by the suction control section 104 when the recording sheet S, such as paper, is moved in the sub scan direction, and thus it is possible to acquire the same advantage as that of the above-described embodiment.

Meanwhile, in each of the embodiments, the ink jet type recording apparatus is shown as an example of the liquid ejecting apparatus. However, the invention is widely provided for a general liquid ejecting apparatus which includes a liquid ejecting head, and it is apparent that the invention can be applied to a liquid ejecting apparatus which includes a liquid ejecting head that ejects liquid other than ink. As other liquid ejecting heads, for example, various types of recording heads which are used for an image recording apparatus, such as a printer, a color material ejecting head which is used to manufacture the color filters of a liquid crystal display or the like, an electrode material ejecting head which is used to form the electrodes of an organic EL display, a Field Emission Display (FED), or the like, a bio-organic substance ejecting head which is used to manufacture bio-chips, and the like are exemplified, and the invention can be applied to a liquid ejecting apparatus which includes the liquid ejecting head.

What is claimed is:

1. A liquid ejecting apparatus comprising:

a liquid ejecting head that relatively moves in a first direction with regard to a discharged medium, and discharges liquid with regard to the discharged medium;

a transport section that relatively transports the discharged medium in a second direction with regard to the liquid ejecting head;

an adsorption section that adsorbs a surface of the discharged medium, which is opposite to the liquid ejecting head; and a control section that performs control such that the adsorption section performs absorption when the liquid ejecting head discharges the liquid with regard to the discharged medium and such that adsorption force is caused to be weak compared to a case in which the liquid is discharged when the discharged medium is relatively transported in the second direction by the transport section;

wherein, when the liquid ejecting head discharges the liquid with regard to the discharged medium, the control section controls the adsorption section such that the adsorption section performs adsorption in a region of the discharged medium, which faces the liquid ejecting head and such that the adsorption force is caused to be weak in a region of the discharged medium which does not face the liquid ejecting head compared to a case in which the region faces the liquid ejecting head.

2. The liquid ejecting apparatus according to claim 1, wherein the adsorption section is provided throughout the first direction, and is configured to be able to change the adsorption force for each of a plurality of regions which are acquired through division throughout the first direction, and wherein the control section controls the adsorption section such that the adsorption section in the region which faces the liquid ejecting head performs adsorption and such that the adsorption section in the region which does not face the liquid ejecting head causes the adsorption force to be weak compared to the case in which the region faces the liquid ejecting head.

3. The liquid ejecting apparatus according to claim 1, wherein the adsorption section is configured to be able to relatively move in the first direction with regard to the discharged medium, and wherein the adsorption section moves with regard to the liquid ejecting head, and is controlled such that the adsorption section performs adsorption in the region which faces the liquid ejecting head and such that the adsorption force is caused to be weak in the region which does not face the liquid ejecting head compared to the case in which the region faces the liquid ejecting head.

4. The liquid ejecting apparatus according to claim 1, wherein the control section controls a print operation of the liquid ejecting head and an absorption operation of the adsorption section based on a print signal.

5. The liquid ejecting apparatus according to claim 1, wherein the control section sets the adsorption force which is applied to the discharged medium to zero on an outer side than the discharged medium.

6. The liquid ejecting apparatus according to claim 1, wherein the transport section relatively transports the discharged medium in the second direction whenever the liquid ejecting head finishes relative movement in the first direction, and wherein the control section controls the adsorption section such that the adsorption force is caused to be weak whenever the transport section transports the discharged medium.

7. The liquid ejecting apparatus according to claim 1, wherein, when the adsorption force is caused to be weak by the adsorption section, the control section sets the adsorption force to 50% of a case in which the adsorption force is not caused to be weak.

8. The liquid ejecting apparatus according to claim 1, wherein the adsorption section is a suction section which adsorbs the discharged medium in such a way as to form negative pressure by sucking the surface of the discharged medium, which is opposite to the liquid ejecting head.

9. The liquid ejecting apparatus according to claim 1, further comprising:

a platen that supports a surface of the discharged medium, which is opposite to the liquid ejecting head while relatively moving with regard to the discharged medium, wherein the adsorption section adsorbs the discharged medium onto the platen.

10. The liquid ejecting apparatus according to claim 9, wherein the adsorption section includes a suction fan, and wherein the suction fan is provided inside of the platen.

11. The liquid ejecting apparatus according to claim 1, wherein, when the discharged medium is relatively transported in the second direction by the transport section, the control section weakens the adsorption force to zero.

12. A method of discharging liquid to a discharged medium by a liquid ejecting head, comprising:

causing a transport section to repeatedly perform an operation of relatively transporting the discharged medium with regard to the liquid ejecting head and an operation of not transporting the discharged medium; and controlling an adsorption section that adsorbs the discharged medium such that adsorption force with regard to the discharged medium becomes weak in a case in which the discharged medium is transported by the transport section, compared to a case in which the discharged medium is not transported by the transport section;

wherein, the adsorption section is controlled such that the adsorption section performs adsorption in a region of the discharged medium, which faces the liquid ejecting head and such that the adsorption force is caused to be weak in a region of the discharged medium which does not face the liquid ejecting head compared to a case in which the region faces the liquid ejecting head.

* * * * *